US006125611A

United States Patent [19]

Focke

[11] Patent Number: 6,125,611

[45] Date of Patent: Oct. 3, 2000

[54] FOLDING DEVICE, ESPECIALLY A FOLDING TURRET, WITH FOLDING MANDREL

[75] Inventor: Heinz Focke, Verden, Germany

[73] Assignee: Focke & Co. (GmbH & Co.), Verden, Germany

[21] Appl. No.: 09/108,972

[22] Filed: Jul. 2, 1998

[30] Foreign Application Priority Data

Jul. 4, 1997 [DE] Germany ..... 197 28 750

[51] Int. Cl.[7] ..... B65B 19/24

[52] U.S. Cl. ..... 53/225; 53/234

[58] Field of Search ..... 53/231, 225, 228, 53/230, 234, 575, 590; 493/153, 295, 910, 911

[56] References Cited

U.S. PATENT DOCUMENTS 4,999,970 3/1991 Bamrungbhuet et al. ..... 53/225 X 5,588,286 12/1996 Focke et al. ..... 53/234 X

FOREIGN PATENT DOCUMENTS 35 45 884 7/1987 Germany .

196 05 354 8/1996 Germany .

*Primary Examiner*—James F. Coan

*Attorney, Agent, or Firm*—Sughrue, Mion, Zinn, Macpeak & Seas, PLLC

[57] ABSTRACT

For the manufacture of soft-pouch packets for cigarettes, folding mandrels (10) configured as hollow bodies are used, on the outer side of which blanks (16, 17) are folded. The outer blank (17) has in the region of one narrow side wall (15) blank portions (23, 24) which overlap one another and are connected to one another by gluing. In the region of the glue connection, there is slight expansion of the cross-section of the package during the hardening of the adhesive. To compensate for this effect, the folding mandrel (10) does not have an exactly rectangular shape. Rather, the narrow side wall (15) adjoining the gluing point has a smaller width ($B_{15}$) than the opposite narrow side wall (14).

8 Claims, 2 Drawing Sheets

FOLDING DEVICE, ESPECIALLY A FOLDING TURRET, WITH FOLDING MANDREL

BACKGROUND OF THE INVENTION

The invention relates to a folding device, especially folding turrets with at least one holding device positioned projecting at one side—a so-called folding mandrel—for the manufacture of an essentially cuboid packet made of at least one foldable blank, especially for cigarettes, the folding mandrel having thin walls, namely large surface front wall and rear wall as well as narrow side walls, for bearing corresponding package walls, and portions of blanks overlapping one another in the region of one of the narrow side walls and being connected there to one another by gluing.

Packaging machines with folding mandrels are primarily employed in the manufacture of cigarette packs, in particular soft-pouch packs. With this type of pack, the overlapping blanks parts are glued to each other. It has been shown that the narrow side wall of the finished pack with the overlap is broader than the opposite side wall.

SUMMARY OF THE INVENTION

The purpose of the invention is to take steps to achieve a package cross-section that is as exactly rectangular as possible.

To achieve this purpose the folding device according to the invention is characterized in that the small side wall on which the overlapping portions of the blank rest has a narrower width than the opposite narrow side wall and thus the folding mandrel itself has a trapezoid cross-section in order to achieve an approximately rectangular cross-section of the finished package.

The invention is based on the finding that after the folding tabs have been glued in the area of the side wall of the folding mandrel, the relative position of the glued folding tabs is altered. To counteract the resulting broadening of the side wall, the folding mandrel has been designed with a correspondingly narrower side wall in this area.

BRIEF DESCRIPTION OF THE DRAWINGS

Further features of the invention arise from the claims. An embodiment, given by way of example, is described in greater detail below with the aid of drawings in which:

DESCRIPTION OF A PREFERRED EMBODIMENT

Figure 1:
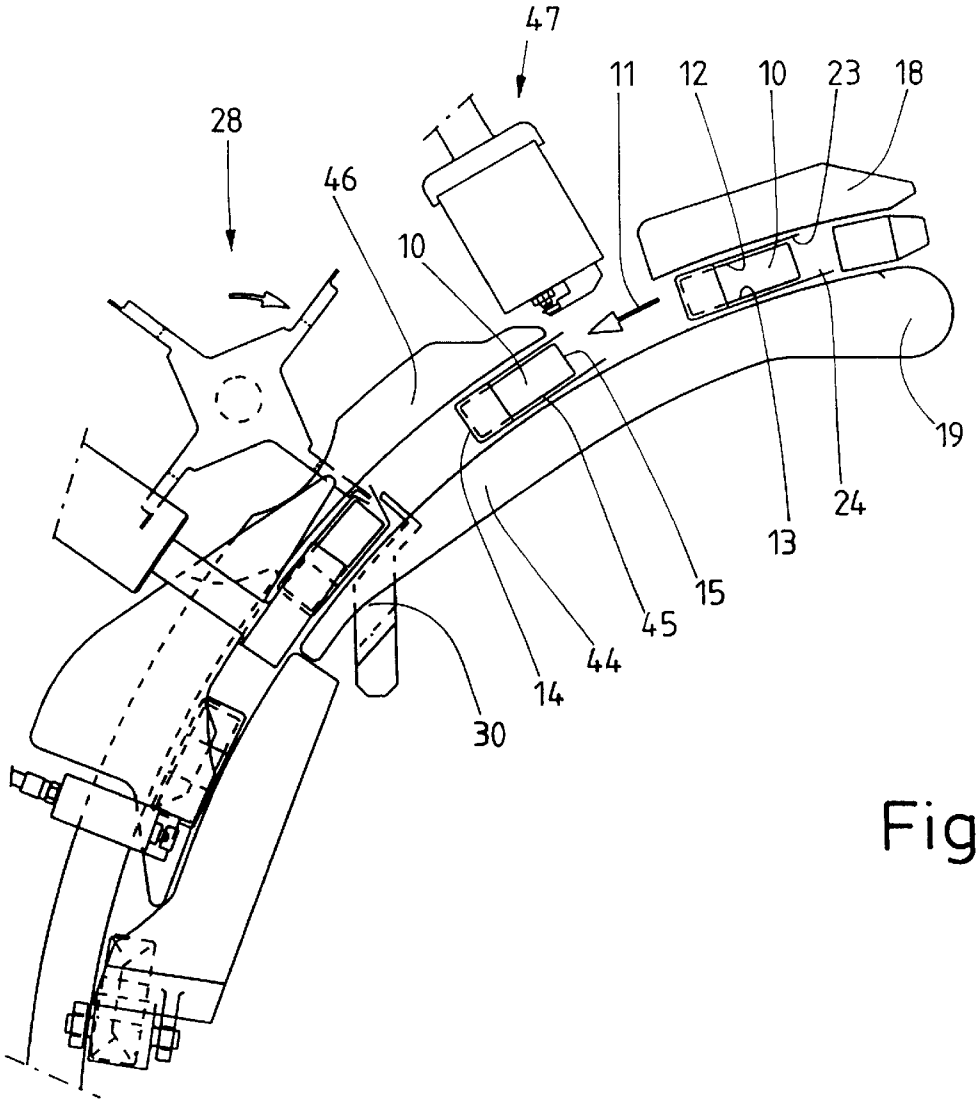
FIG. 1 shows a peripheral region or section of a folding turret with a plurality of folding mandrels, in side view.
Figure 4:
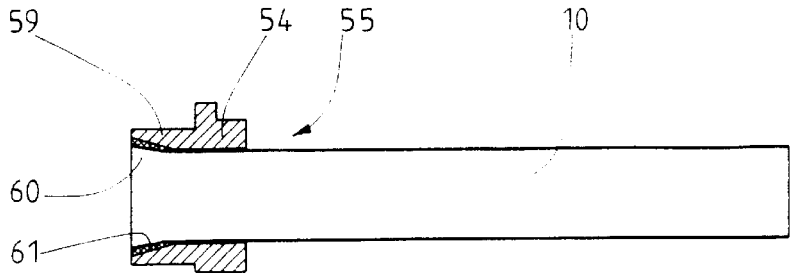
FIG. 4 shows the folding mandrel according to FIG. 3, in longitudinal section.

The exemplary embodiment shown in the drawings relates to the manufacture of cigarette packs of the soft-pouch type. A folding turret (not shown), for example in the embodiment pursuant to DE 35 45 884, is provided with a plurality of folding mandrels 10 arranged along its outer circumference. A folding mandrel 10 is a hollow tubular member upon whose outer circumference blanks of the pack are folded. The folding mandrel 10 is moved by the folding turret in the direction of the arrow 11.

The folding mandrels 10 are positioned on the folding turret in such a way that one large-surface rear wall 12 is oriented radially outwards, and a corresponding front wall 13 lies inside in relation to the radial direction 25 of the folding turret. A narrow side wall 14 lying at the front in the direction of rotation, as well as a narrow side wall 15 lying at the back in the direction of the rotation, are aligned approximately radially.

The blanks forming the package are folded in succession on the outer side of the folding mandrel 10 (DE 196 41 151.3). First of all, an inner blank 16—a tinfoil blank—is folded and thereafter, on the outside of same, an outer wrapping, namely a paper blank 17 for the so-called soft pouch.

The blank 17 for the soft pouch is held ready in a position aligned radially to the folding turret between successive folding mandrels 10 and taken along by the next folding mandrel in the direction of conveying. In the region of first fixed folding members 18, 19, lying radially outside and inside, the blank 17 of the soft-pouch is folded in a U-shape around the folding mandrel 10, through the movement of the folding mandrel 10 with the blank relative to the fixed folding members 18, 19.

The blank 17 for the soft pouch is of such dimensions and is held ready in such a way relative to the folding mandrel 10 that, after folding in a U-shape on the rear side of the folding mandrel in the direction of conveying i.e. in the region of the narrow side wall 15, the folding flaps protrude to form a side wall 22 of the soft pouch. In the present case, these are side flaps, namely a narrower inner flap 23 and a wider outer flap 24, When the side wall 22 of the package is completely folded, the inner flap 23 lies on the inner side and is at least partially covered by the outer flap 24.

On the finished packet, inner flap 23 and outer flap 24 are connected to one another by gluing. This is effected by glue spots which are applied to one of the side flaps, i.e. to the outer side of the inner flap. To make the side wall 22, once the glue spots have been applied, the inner flap 23 is folded around against the outer side of the side wall 15 of the folding mandrel 10 lying to the rear in the direction of rotation, and then the outer flap 24 is folded by a folding movement carried out in a radial direction towards the outside against the inner flap 23.

The partially folded soft-pouches are led by the folding mandrel 10 to a folding station 28. In the region of the latter, the inner flap 23 is folded against the rear side of the folding mandrel 10, i.e. against the side wall 15 of same lying at the back.

At approximately the same time, the outer flap 24 lying on, the inside in the radial direction is folded by a folding device 30 against the rear side of the folding mandrel and thus against the inner flap 23 folded immediately before.

Along the movement path of the folding mandrels 10, guide members, comprising predominantly a plurality of parallel ribs or webs, are provided on the outer and inner side in a radial direction. Thus the U-shaped folding member 19 lying radially inside is configured in its extension as a radially inner support 44. An arm 45, lying inside, of the U-shaped folded blank adjoins this support 44.

The upper or lying radially outside, U-shaped folding member 18 is configured correspondingly, extends however only over a short peripheral section of the folding turret. At a distance from the U-shaped folding member 18, an external guide 46 follows in the peripheral direction. Positioned in the region of a gap between the U-shaped folding member 18 and outer guide 46 is a gluing assembly 47.

Details of the folding turret not shown can be configured in a suitable way, for example in accordance with DE 35 45 884. In addition, the described steps of the method and details of the device are also suitable for the production of other packages, for example for the production of packages of the hinge-lid type made of thin cardboard.

The formation of the side wall 22 through folding and gluing of inner flap 23 and outer flap 24 is not completed until the glue applied to the inner flap 23 has hardened. During the time necessary for this, the outer wrapping adjacent to the folding mandrel 10 is not permanently supported. Inner flap 23 and outer flap 24 are also only pressed for a short time against the side wall 15 of the folding mandrel 10. Thus displacements can arise in the region of the glue connection. In fact, the cross-section of the outer wrapping 10 expands somewhat in this region.

To compensate for this effect, the folding mandrel 10 is designed in a special way. Namely, it does not have an exactly rectangular cross-section but rather a trapezoid configuration. The side wall 15 at the rear in the conveying direction and on which the side wall 22 formed by the overlap of inner flap 23 and outer flap 24 come to rest, has a smaller width $B_{15}$ than the width $B_{14}$ of the side wall 14 lying at the front in the conveying direction. In concrete terms, the difference in width amounts to 1 mm with a width $B_{15}$=20.6 mm and a width $B_{14}$=21.6 mm. The width of front wall 13 and rear wall 12 is approximately 54.3 mm.

The trapezoid shape of folding mandrel cross-section which arises is aligned in a special manner. Thus there are in each case right angles between the radially inner front wail 13 and side wall 14 or side wall 15. Thus an acute angle is formed between the rear wall 12 and the side wall 14 lying at the front in the conveying direction, while an obtuse angle is formed between the rear wall 12 and the side wall 15 lying to the rear in the conveying direction.

Because of the different widths $B_{15}$ and $B_{14}$, mentioned above, an angle $\alpha$ of 88° arises between side wall 14 lying at the front and rear wall 12 lying on the outside. Depending on the material and the glue connection, the angle can vary between 88° and 89.5°.

The width difference $B_{14}$ minus $B_{15}$ is 4%–6% (relative to $B_{14}$) or 1%–3% (relative to the width of front wall 13 or rear wall 12).

Likewise of importance in this connection is the position of the overlap of inner flap 23 and outer flap 24. Inner flap 23 is configured shorter than outer flap 24. Correspondingly, the overlap lies closer to the rear wall 12 than to the front wall 13. The inner wrapping 16 also has an overlap of blank portions 50, 51, this overlap being approximately central in the region of the rear wall 12. The glue points and overlaps are thus disposed in the region of the rear wall 12 lying on the outside and delimited by acute and obtuse angles and thus lie at a distance from the front wall 13 and the adjoining right angles. Thus the best optical impression for the front view of the later finished pack is preserved despite any possible folds or displacements in the region of glue points.

The folding mandrels 10 are only mounted or anchored at one end, this being on a carrying disc 52 of the folding turret. The basic structure and the mounting of the folding mandrel are also described in DE 44 37 404.

Figure 3:
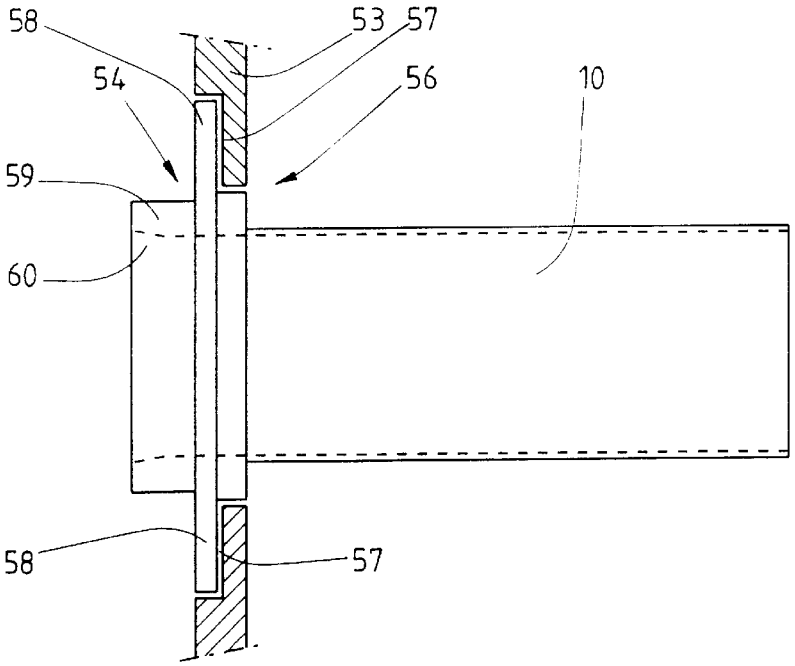
FIG. 3 shows a folding mandrel as a portion of a folding turret, in radial plan view.
Figure 2:
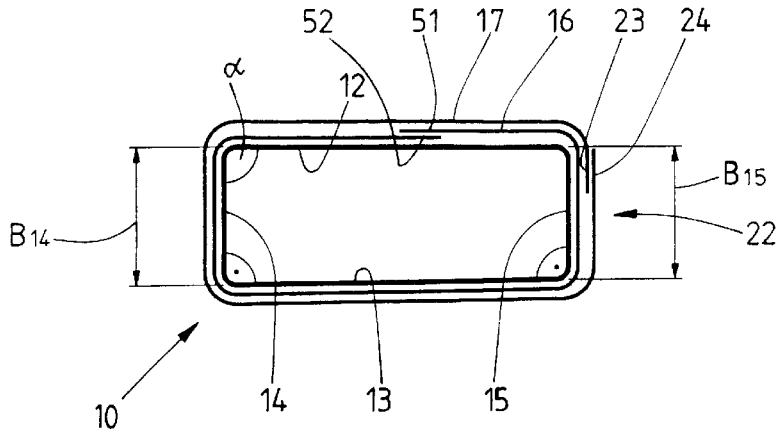
FIG. 2 shows a folding mandrel as a portion of a folding turret with two blanks of a soft pouch packet wrapped on it, in cross-section.

In order to anchor the folding mandrel 10 on one side, the latter has at one end 53 a connecting piece 54 which completely surrounds the folding mandrel 10 at its end 53 and terminates flush with its end 53 (FIG. 3). The connecting piece 54 is configured so that it can be connected effectively with the folding turret or the carrying disc 53.

The end 53 of the folding mandrel 10 sits in an aperture 55 of the connecting piece 54. The latter is connected with the carrying disc 53 of the folding turret. To this end, the carrying disc 52 is provided with apertures 56 into each of which one folding mandrel 10 may be inserted with a connecting piece 54, fitting as a unit and as a form fit. The aperture 56 is configured in cross-section in stepped shape, at least in the region of two facing sides. In this way a displacement 57 is produced. Fitting into the latter is a flange 58 of the connecting piece 54 extending on both sides. This type of connection is also described in DE 44 37 404.

The connecting piece 54 has an aperture collar 59 on its side turned away from the folding mandrel 10. This collar receives the end of the folding mandrel 10 facing the folding turret or the carrying disc 52. The end 53 mentioned serves to insert the package contents, namely a group of cigarettes, into the folding mandrel 10 and is formed in a funnel shape. To this end, in the region of the aperture collar 59, rear wall 12, front wall 13 and side walls 14 and 15 are formed diverging outwards. At the same time, the end 53 terminates flush with the aperture collar 59. The trapezoid cross-section of the folding mandrel 10 can also be present in the region of the end 53 or of the aperture collar 59.

The cross-section of the folding mandrel 10 (end 60) and the cross-section of the connecting piece 54 are matched to one another in such a way that between the two parts (along the connecting piece) a gap 61 of 0.5 mm to 2 mm in width is produced. The secure connection of both portions is ensured by a two-component adhesive introduced into this gap 61.

What is claimed is:

1. A rotary folding device, rotatable in a rotation direction around an axis, comprising at least one folding mandrel (10), positioned on an outer periphery of said folding device, for the manufacture of an essentially cuboid package made of at least one foldable blank (17), the folding mandrel (10) having thin walls, namely a large-surface front wall (13) and a large-surface rear wall (12) as well as two opposing narrow side walls (14, 15), for bearing corresponding walls of the package, and said blank having portions (23, 24) which overlap one another in a region of one of the two narrow side walls (15) and which are connected there to one another by gluing, wherein the narrow side wall (15) that bears the overlapping blank portions (23, 24) has a narrower width ($B_{15}$) than the opposite narrow side wall (14), so that the folding mandrel (10), in order to achieve an almost exactly rectangular cross-section of the finished package, itself has a trapezoidshaped cross-section.

2. The device according to claim 1, wherein the angles adjoining one of the large-surface walls (12, 13)—the angles between the large-surface wall (12 or 13) and the adjacent narrow side walls (14, 15)—are right angles.

3. The device according to claim 1, wherein each said folding mandrel (10) is arranged on the rotary folding device to protrude in an axial direction with the narrow side walls (14, 15) pointing in the peripheral direction and the large-surface front and rear walls (12, 15) pointing in a radial direction, and wherein the large-surface front wall (13), lying radially inwards, forms right angles with both of the narrow side walls (14, 15), and wherein the large-surface rear wall (12), lying radially outside, forms an acute angle ($\alpha$) and an obtuse angle, respectively, with the two narrow side walls (14, 15).

4. The device according to claim 1, the narrow side wall (14) lying forward in the direction of rotation is broader than the narrow side wall (15) lying rearward in the direction of rotation.

5. The device according to claim 3, wherein the acute angle (α) is 88.0° to 89.5°.

6. The device according to claim 1, wherein one of the narrow side walls (15) has a width which is approximately 4%–6% smaller than that of the other narrow side wall (14).

7. The device according to claim 1, wherein one of the narrow side walls has a width which is approximately 1%–3% small—in relation to the width of the large-surface front and rear wall (12, 13)—than that of the other narrow side wall (14).

8. The device according to claim 2, wherein each said folding mandrel (10) is arranged on the rotary folding device to protrude in an axial direction with the narrow side walls (14, 15) pointing in the peripheral direction and the large-surface front aid rear walls (12, 15) pointing in a radial direction, and wherein the large-surface front wall (13), lying radially inwards, forms right angles with both of the narrow side walls (14, 15), and wherein the large-surface rear wall (12) lying radially outside, forms an acute angle (α) and an obtuse angle, respectively with the two narrow side walls (14, 15).

* * * * *